US006557308B1

(12) United States Patent
Snel

(10) Patent No.: US 6,557,308 B1
(45) Date of Patent: May 6, 2003

(54) BUILDING STRUCTURE

(75) Inventor: Wilhelmus Jan Reinier Karel Snel, Abbekerk (NL)

(73) Assignee: Snel Golfkarton B.V. (NL)

( * ) Notice: Subject to any disclaimer, the term of this patent is extended or adjusted under 35 U.S.C. 154(b) by 52 days.

(21) Appl. No.: 09/615,145

(22) Filed: Jul. 13, 2000

(51) Int. Cl.[7] ..... E04H 14/00

(52) U.S. Cl. ..... 52/79.4; 52/79.5; 52/81.6; 52/783.11; 52/783.19

(58) Field of Search ..... 52/630, 160, 169.14, 52/79.2, 79.1, 79.4, 79.5, 79.14, 81.6, 576, 577, 783.11, 783.19

(56) References Cited

U.S. PATENT DOCUMENTS 3,747,290 A * 7/1973 Barrell et al. ..... 52/92
3,800,485 A * 4/1974 Yates ..... 52/90
3,883,999 A * 5/1975 Nicoll, Jr. ..... 52/90
4,021,983 A * 5/1977 Kirk, Jr. ..... 52/618
4,074,476 A * 2/1978 Ordorika ..... 52/79.2
4,087,949 A * 5/1978 Hill ..... 52/309.13
4,827,690 A * 5/1989 Viger ..... 52/782
4,828,132 A * 5/1989 Francis, Jr. et al. ..... 220/6
5,163,555 A * 11/1992 West et al. ..... 206/386
5,361,923 A * 11/1994 Knight, IV et al. ..... 280/6

* cited by examiner

*Primary Examiner*—Yvonne M. Horton
(74) *Attorney, Agent, or Firm*—Jones, Day, Reavis & Pogue

(57) ABSTRACT

A building accessible to persons, which comprises at least one constructional element, which element is tubular and which is at least substantially made of wound-together layers of a strip of paper/cardboard, wherein each layer is at least substantially made up of a corrugated sublayer and a flat sublayer affixed to one side thereof.

12 Claims, 4 Drawing Sheets

BUILDING STRUCTURE

BACKGROUND OF THE INVENTION

1. Field of the Invention

The invention relates to a building accessible to persons, which comprises at least one constructional element forming walls of a space within said building, which element is tubular and which is at least substantially made of wound-together layers of a strip of sheet material.

2. Description of the Related Art

Such a building is known from U.S. Pat. No. 3,730,796 (Richards). Said U.S. patent discloses a construction system wherein a collapsible, rotatable mold is used to eventually form a tubular constructional element which makes up the walls of the building. The tubular constructional element consists of inner and outer layers of a rigid material, such as fiberglass, with a filling material having thermally insulating properties present therebetween.

One drawback of the building which is known from the aforesaid U.S. patent publication is the fact that, because of the amount and the nature of the materials being used, namely a sandwich construction of fibreglass and filling material, it is relatively complicated and thus relatively costly, which makes the known building unattractive from an economic point of view.

The object of the invention is to provide a simple yet elegant and inexpensive building which is accessible to persons, which comprises at least one constructional element, and in order to accomplish that objective, a building of the kind referred to in the introduction is characterized in that said constructional element is at least substantially made of wound-together layers of a strip of paper/cardboard, wherein each layer is at least substantially made up of a corrugated sublayer and a flat sublayer affixed to one side thereof. The wound-together paper/cardboard layers are interconnected via a glue which has been applied to ridges of the corrugated sublayers. Thus, very strong walls are obtained in a simple yet elegant manner, which walls have excellent insulating properties, due to the "cellular structure" of the corrugated cardboard which is used.

SUMMARY OF THE INVENTION

In one preferred embodiment of a building according to the invention, said constructional element forms a cross section of the building. More particularly, at least two constructional elements are provided for enlarging the building, which constructional elements are interconnected via an adhesive (glue) applied to their respective longitudinal edges. When identically shaped standard constructional elements are used, a "modular" construction of the building is possible. It is advisable to provide the constructional element with a weather resistant coating, which is in particular also flame resistant, so as to make the building optimally fire-resistant.

In another preferred embodiment of a building according to the invention, the constructional element can be folded from an at least substantially flat position to an erected position, and vice versa. Preferably, the constructional element comprises weakened spots, in particular cuts, which function as hinge points, in order,to make it possible to fold the constructional element from said at least substantially flat position to said erected position, and vice versa. Unlike the construction system disclosed in the above-mentioned U.S. Pat. No. 3,730,796 (Richards). It is now possible to transport constructional elements according to the invention from a production location to a destination in a flat transport position, that is, a position in which they take up little space. Consequently, the location where the present constructional elements are produced does not have to be the location where the constructional elements are used to form a building, as is the case with the prior art constructional elements.

In another preferred embodiment of a building according to the invention, the constructional element can be folded from an at least substantially flat position to an erected position, and vice versa. Preferably, the constructional element comprises weakened spots, in particular cuts, which function as hinge points, in order to make it possible to fold the constructional element from said at least substantially flat position to said erected position, and vice versa. Unlike the construction system disclosed in the above-mentioned U.S. Pat. No. 3,730,796 (Richards). It is now possible to transport constructional elements according to the invention from a production location to a destination in a flat transport position, that is, a position in which they take up little space. Consequently, the location where the present constructional elements are produced does not have to be the location where the constructional elements are used to form a building, as is the case with the prior art constructional elements.

In another preferred embodiment of a building according to the invention, the constructional element is impregnated, in particular with a resinous material. The impregnation preferably takes place by vapor deposition, spraying or otherwise, wherein said vapor deposition or said spraying takes place in a direction parallel to the direction of the "cellular structure" of the corrugated paper/cardboard being used. The advantage of said impregnation is not only the fact that it provides protection against external influences, such as moisture, but also that it increases the structural strength. In principle, fewer layers of corrugated paper/cardboard are thus needed in order to give the present constructional element the required strength, so that the constructional element can be produced more quickly and at lower cost.

The invention furthermore relates to a method of producing a constructional element for a building according to the invention, wherein a continuous strip of sheet material is supplied, which strip is attached to a forming mold with one end and subsequently wound round said forming mold and cut off, characterized in that the continuous strip of sheet material is a single-faced corrugated paper layer, to which a film of glue is applied on one side, in particular to free ridges of the corrugated paper. The single-faced corrugated paper layer consists of a single flat sublayer and a single corrugated sublayer, and the single-faced corrugated paper layer is wound with its flat sublayer abutting against the mold.

In another preferred embodiment of a method according to the invention, the single-faced corrugated paper layer is supplied from a supply roll or directly from a machine on which the single-faced corrugated paper layer has been formed from originally two continuous flat paper layers.

The invention furthermore relates to a constructional element for use in a building according to the invention.

BRIEF DESCRIPTION OF THE DRAWINGS

The invention will be explained in more detail hereafter with reference to figures illustrated in a drawing of a preferred embodiment of the invention, wherein.

DETAILED DESCRIPTION OF THE PREFERRED EMBODIMENTS

Figure 1:
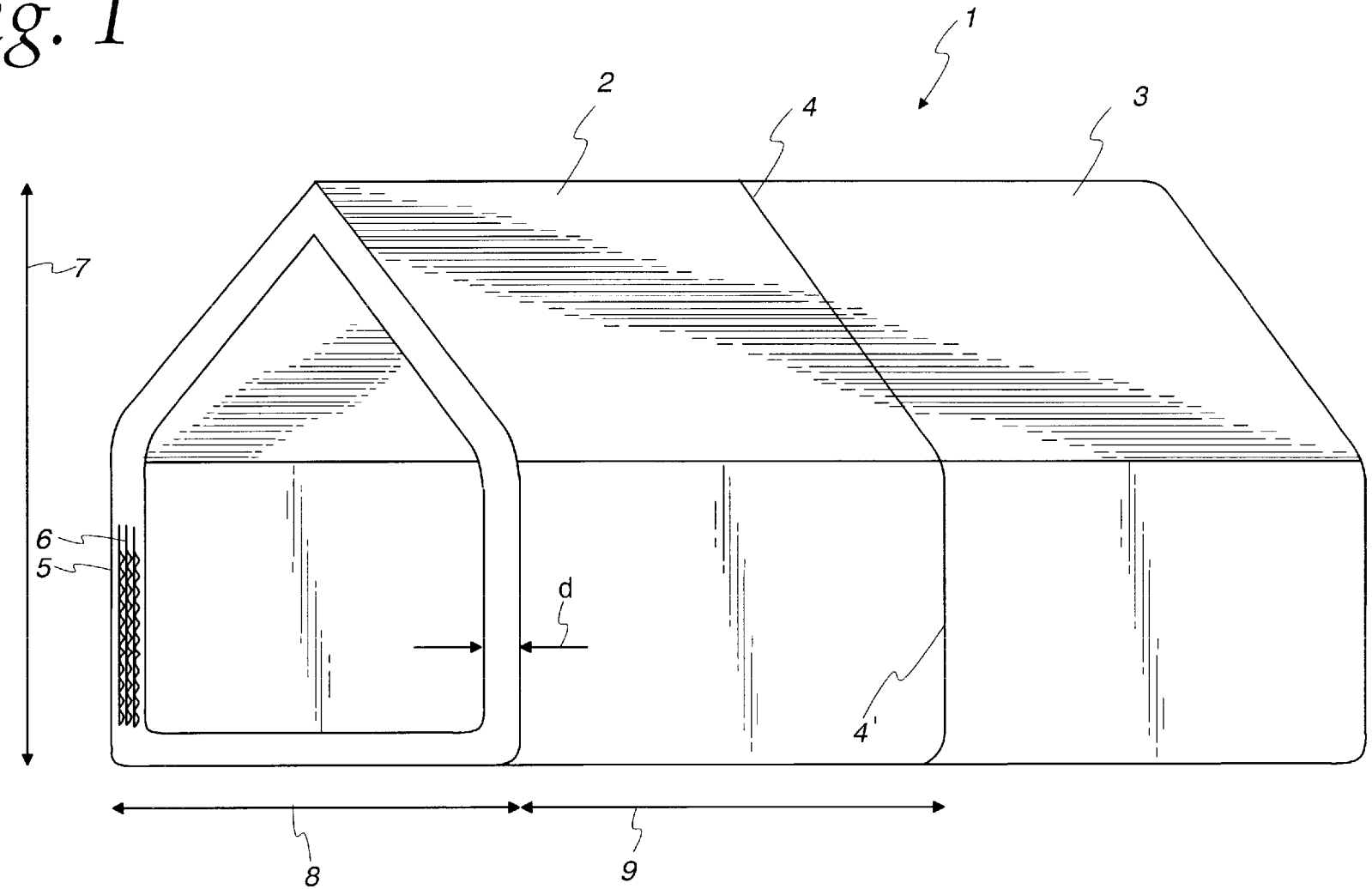
FIG. 1 is a schematic, perspective view of a building according to the invention, showing two bonded-together constructional elements in the form of cross segments.

FIG. 1 shows a building 1, which is built up of two constructional elements 2, 3, each in the form of a cross section of the building, which constructional elements 2, 3 are interconnected along their facing longitudinal edges 4, 4' by means of a glue. Each constructional element is made of wound-together layers 5, 6 . . . from a strip of corrugated paper/cardboard. In particular, said constructional elements 2, 3 have a height designated by the numeral 7 of 2.5–3.5 m, a width designated by the numeral 8 of 3–5 m and a length designated by the numeral 9 of 1.2–2.4 m. Each constructional element has a thickness "d" of 6–10 cm, which corresponds to 25–40 windings. The facades or the upright walls on the end sides of the building 1 are formed separately of paper/cardboard, metal or wood, and they are connected, for example glued, to respective constructional elements 2, 3.

Figure 2:
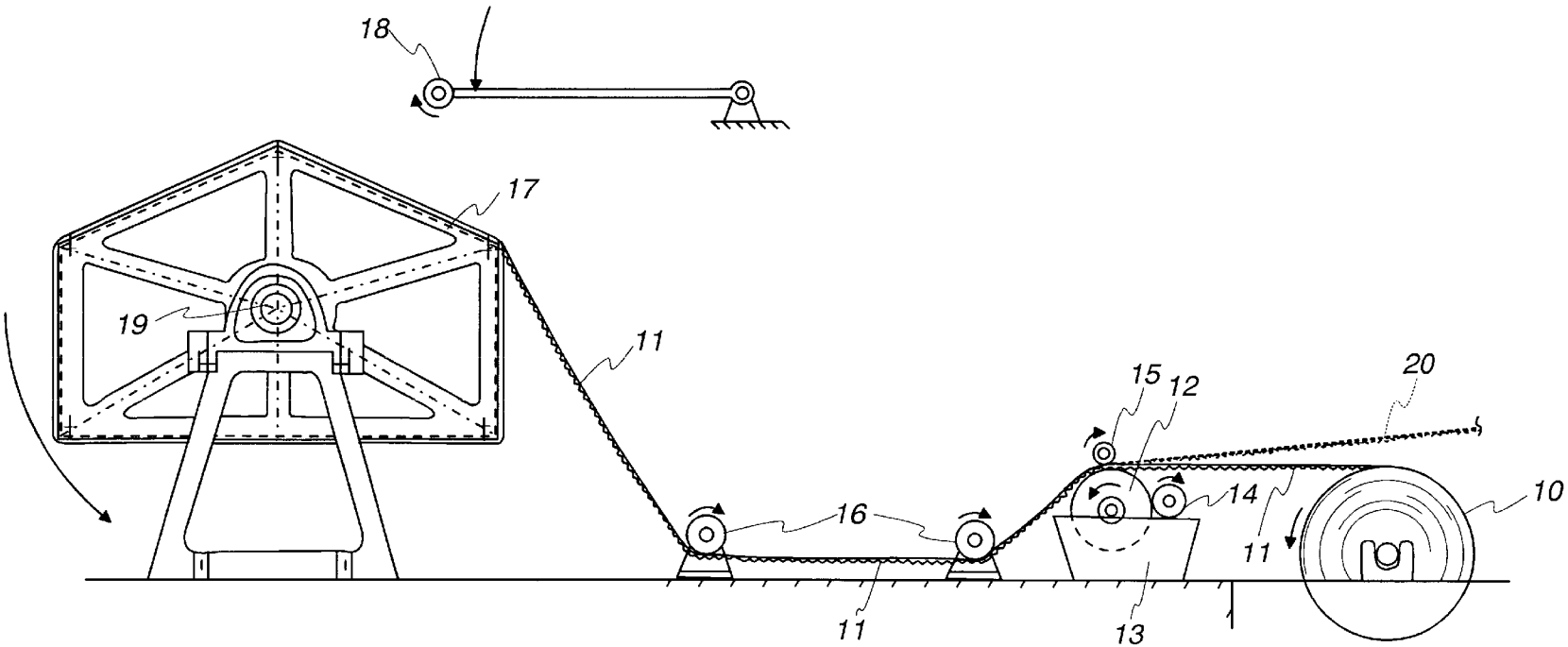
FIG. 2 is a schematic side view of a device for carrying out the method according to the invention.

FIG. 2 is a schematic side view of a machine for winding a constructional element as shown in FIG. 1. A supply roll 10 of single-faced corrugated paper, that is, consisting of a flat paper layer, on which a corrugated paper layer 11 is glued. In the illustrated embodiment, the corrugations are present on the underside of the paper layer. The single-faced corrugated paper web is then passed over a glue roller 12. The glue roller is disposed in a glue container 13 and cooperates with a counter roller 14 so as to determine the thickness of the film of glue to be applied. The rollers move in the directions indicated by the arrows. Disposed above the glue roller 12 is a press-on roller 15, which functions to effect the desired contact of the corrugated paper ridges to the glue roller 12. The corrugated paper web, to which a glue has been applied, is passed to a winding mold or forming mold 17 via a number of guided rollers 16. The winding or forming mold has an external contour which corresponds to the desired internal contour of the constructional element to be formed. In the illustrated example this is a pentagonal prism with rounded corners, but also other forms, such as triangular, rectangular, hexagonal and the like are possible, of course.

When the ridges of the corrugations are directed inwards on the winding mold, as is shown in FIG. 2, it is preferred to place a flat paper layer on the mold before supplying the corrugated paper web. When the single-faced corrugated paper layer is wound with the corrugations directed outwards, it is not necessary to provide such a flat inner layer. In both cases an additional cover layer is provided after completion of the winding operation, preferably a paper layer or a flexible metal layer, such as an aluminum layer, which has been prepared, for example against weather influences. After the end of the corrugated paper web has been attached to the mold, said mold is rotated a desired number of times, for example twenty-five times or more, and the corrugated paper web is cut off to the desired length. In order to effect a good contact between the various layers, a press-on roller 18 may be used, which presses the corrugated paper layers on the mold together. The mold 17 itself is supported in bearings on a shaft 19, which bearings (not shown) can be removed on one side, whilst the bearings may also be absent on one side, so as to make it possible to remove a wound product from the mold in an axial direction. Shaft 19 itself is driven via a driving mechanism (not shown). Insofar this is necessary or desirable, conventional heating means may be used for heating the paper so as to facilitate deformation thereof and/or to accelerate the curing of the glue. Furthermore it is possible to use mechanical and/or pneumatic means for holding down the end of a corrugated paper web to the mold.

Although a supply roll of single-faced corrugated paper 10 is shown, the device may also be positioned directly behind a machine for producing single-faced corrugated paper, so that continuous production is possible. In that case, the supply of paper 20 can take place as illustrated in broken lines.

Furthermore it is noted that the above description is based on the use of single-faced corrugated paper built up of one flat layer and one corrugated paper layer, but it is also possible, depending on the respective requirements, to use multiple layers, possibly of varying thickness, and possibly layers of paper having specific properties or a film layer of some kind, such as a flexible metal layer, in particular an aluminum layer. Although this is not shown in the figures, it will be apparent that a number of knives may be disposed near the winding mold 17, whose axial spacing will be adjustable and which function to divide the tubular constructional element into a number of shorter tubular elements. While the present embodiment uses twenty-five windings, it is also possible to provide many more windings, for example thirty or forty, or even more.

Figure 3:
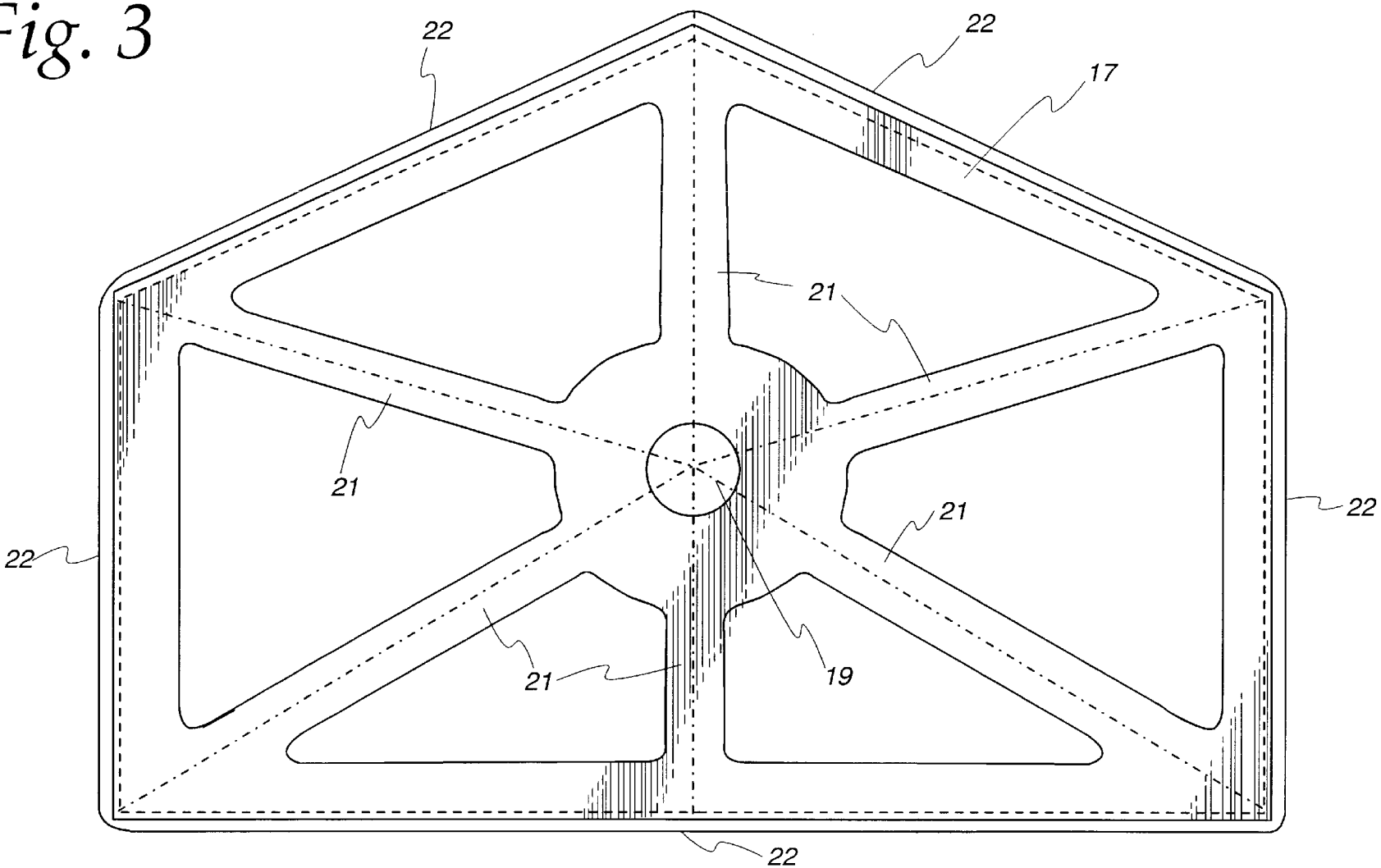
FIG. 3 shows a detail of the device of FIG. 2.

In FIG. 2, the forming mold 17 is shown on a slightly smaller scale than the other parts of the device so as not to make the figure unnecessarily complicated. FIG. 3 shows another side view of the mold 17 of FIG. 2. The mold 17 forms a pentagonal prism, with beams or ribs 21 being used. The whole has rounded comers, and slightly convex sides 22, seen from the inside, for pressing the various wound-together corrugated paper layers firmly together into abutting relationship.

The device as shown in FIG. 2 is preferably mobile, that is, it can be loaded on a (trailer of a) truck, so that constructional elements according to the invention can be economically formed on-site by means of the device.

Figure 4A:
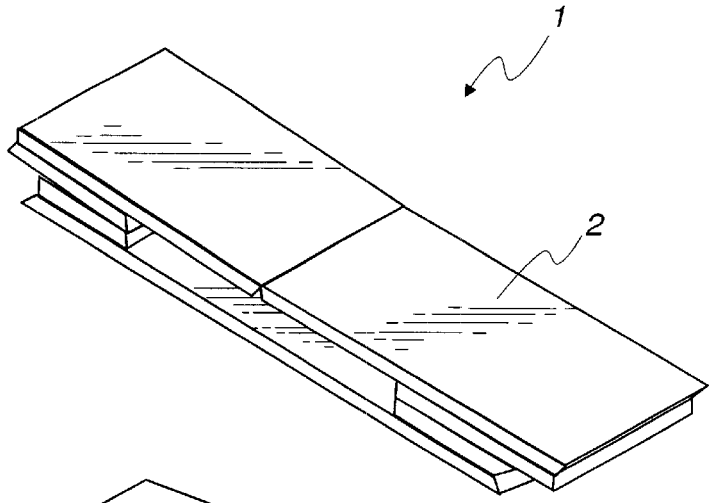
FIG. 4 is a schematic, perspective view of a preferred variant of a constructional element as shown in FIG. 1.
Figure 4B:
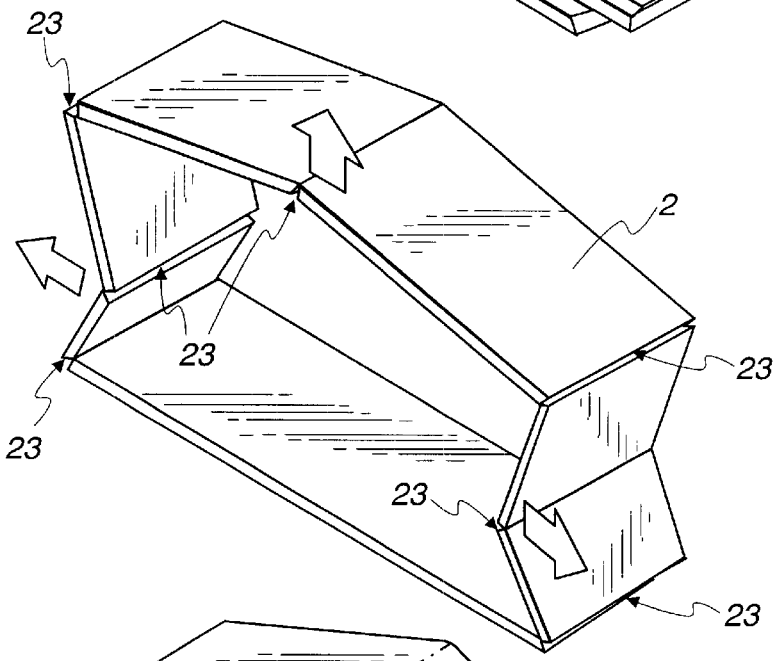
Figure 4C:
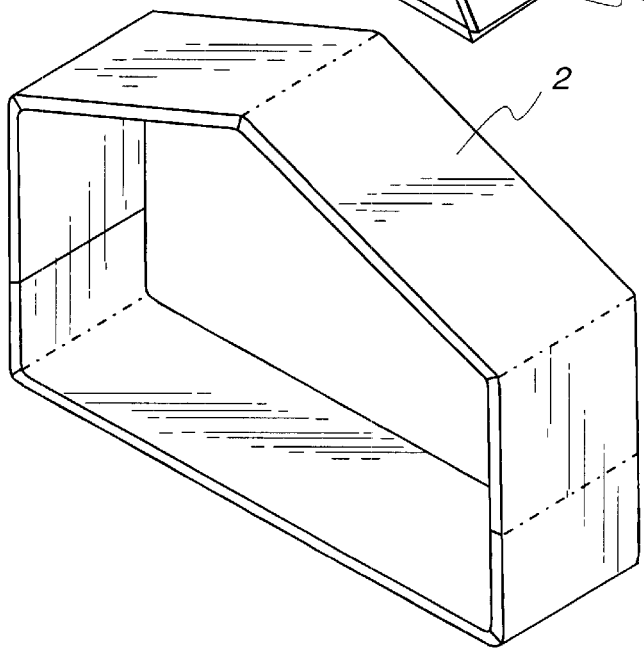

FIG. 4 relates to a preferred variant of the constructional element 2, 3 of FIG. 3, wherein the constructional element 2, 3 can be folded from an at least substantially flat transport position FIG. 4(*a*) to an erected operational position FIG. 4(*c*). This is done by providing the constructional element 2, 3 with weakened spots 23, shown in FIG. 4(*b*) in strategic places, which weakened spots function as hinge points. The weakened spots are preferably formed by cuts, which in particular extend to a depth of a few layers into the corrugated paper/cardboard. By providing the cuts alternately inwards and outwards in corner points, as indicated, and at least substantially in the centre of the upright side walls of the constructional element 2, 3, it can be folded from the flat transport position to the erected operational position, and vice versa, by locally exerting a force in the direction indicated by the arrows. An important advantage of this arrangement is that the constructional element 2, 3 takes up little space during transport, thus enabling economic transport to the location where the building is to be erected. This location no longer needs to be the location where the constructional elements 2, 3 are made.

It is preferred to impregnate the corrugated paper/cardboard constructional element 2, 3 with a resin material, in particular epoxy resin. The advantage of this is not only that protection is provided against external influences, such as moisture, but also that the structural strength is increased. In principle, fewer layers of corrugated paper/cardboard are thus needed in order to give the constructional element the required strength, so that the constructional element can be produced more quickly and at lower cost. The impregnation preferably takes place by vapor deposition, spraying or otherwise, wherein said vapor deposition or said spraying takes place in a direction parallel to the direction of the "cellular structure" of the corrugated paper/cardboard being used.

The invention is not restricted to the above-described embodiment(s), also other variants are possible within the scope of the invention.

What is claimed is:

1. A building accessible to persons, which comprises:

at least one constructional element forming walls of a space within said building;

which element is tubular and which is at least substantially made of wound-together layers of a strip of sheet material;

characterized in that said constructional element is at least substantially made of wound-together layers of a strip of paper/cardboard; and wherein each layer is at least substantially made up of a corrugated sublayer and a flat sublayer affixed to one side thereof, there being an absence of inner and of outer layers of rigid material image.

2. A building according to claim 1, wherein:

said wound-together paper/cardboard layers are interconnected via a glue which has been applied to ridges of the corrugated sublayers.

3. A building according to claim 1, wherein:

said constructional element forms a cross section of the building.

4. A building according to claim 1, wherein:

said constructional element is provided with a weather-resistant coating.

5. A building according to claim 1, wherein:

at least two constructional elements are provided, which are interconnected via an adhesive applied to their respective longitudinal edges.

6. A building according to claim 1 wherein:

said constructional element is foldable from an at least substantially flat position to an erected position, and vice versa.

7. A building according to claim 6, wherein:

the constructional element comprises weakened spots, cuts, which function as hinge points, in order to make it possible to fold the constructional element from said at least substantially flat position to said erected position, and vice versa.

8. A building according to claim 1, wherein the constructional element is impregnated, with a resinous material.

9. A method of producing a constructional element for a building wherein:

a continuous strip of sheet material is supplied, which strip is attached to a forming mold with one end and subsequently wound around said forming mold and cut off, characterized in that the continuous strip of sheet material is a single-faced corrugated paper layer, to which a film of glue is applied on one side, there being an absence of inner and of outer layers of rigid material.

10. A method according to claim 9, wherein:

said film of glue is applied to free ridges of the corrugated paper.

11. A method according to claim 9, wherein:

said single-faced corrugated paper layer consists of a single flat sublayer and a single corrugated sublayer, and the single-faced corrugated paper layer is wound with its flat sublayer abutting against the mold.

12. A method according to claim 9, wherein:

said single-faced corrugated paper layer is supplied from a supply roll or directly from a machine on which the single-faced corrugated paper layer has been formed from originally two continuous flat paper layers.

* * * * *